US005277494A

United States Patent [19]

Lehrke et al.

[11] Patent Number: 5,277,494

[45] Date of Patent: Jan. 11, 1994

[54] FLUID INTEGRATOR

[75] Inventors: Kenneth E. Lehrke, Maple Grove, Minn.; Martin P. McCormick, Lake Zurich, Ill.

[73] Assignee: Graco, Golden Valley, Minn.

[21] Appl. No.: 62,618

[22] Filed: May 11, 1993

[51] Int. Cl.[5] ..... B01F 5/06

[52] U.S. Cl. ..... 366/339

[58] Field of Search ..... 366/336, 337, 338, 339, 366/340, 165, 176; 138/42

[56] References Cited

U.S. PATENT DOCUMENTS

| | | | |
|---|---|---|---|
| 1,189,478 | 7/1916 | Pfouts | 366/339 |
| 2,512,471 | 6/1950 | Trist | 366/339 |
| 2,833,840 | 5/1958 | Longwell . | |
| 3,223,388 | 12/1965 | Knox | 366/339 |
| 3,709,468 | 1/1973 | Ives | 366/336 |
| 3,790,030 | 2/1974 | Ives . | |
| 4,049,241 | 9/1977 | Taniguchi . | |
| 4,093,188 | 6/1978 | Horner . | |
| 4,117,551 | 9/1978 | Books et al. . | |
| 4,511,258 | 4/1985 | Federighi et al. . | |
| 4,850,704 | 7/1989 | Zimmerly et al. . | |
| 4,884,894 | 12/1989 | Hashimoto et al. . | |

FOREIGN PATENT DOCUMENTS 0116879 2/1984 European Pat. Off. .

*Primary Examiner*—Robert W. Jenkins

*Attorney, Agent, or Firm*—Palmatier, Sjoquist & Helget

[57] ABSTRACT

A liquid integrator apparatus for insertion into a liquid flow line, for blending together leading and lagging incremental liquid flow volumes, the apparatus including a housing attachable to the liquid flow line, a cylindrical insert in the housing, the insert having a helical groove about its outer surface. The helical groove is substantially deeper than it is wide, and has a hydraulic radius of less than about 0.04, and the helical groove is sufficiently long so as to contain a liquid volume approximately twice the volume of incremental liquid for which blending is desired.

7 Claims, 1 Drawing Sheet

FLUID INTEGRATOR

BACKGROUND OF THE INVENTION

The present invention relates to devices for allowing homogeneously blending two or more liquid components into a uniform composition. More particularly, the invention relates to the mixing and blending of liquid coating materials, wherein the materials may be formed of two or more components which are initially segregated, and are mixed into a uniform consistency at or near the point of application. The applicator for coating materials of the general type is typically a spray gun or other similar device, and the delivery vehicle for providing coating materials to the applicator is typically a reciprocable pumping system.

There are a great many liquids which find useful purpose in industry, and which are formed by proportioning and mixing several different liquid components prior to application. Included among such liquids are various types of paints, sealants and adhesives, each of which are typically stored in component containers, and the plural components are proportioned and mixed during the application process. Liquid pumping equipment may be connected to the individual component containers, and the pumping equipment may be controlled so as to withdraw a predetermined ratio of components from the respective containers for delivery over a single liquid delivery line. Static mixing manifolds are typically placed into the liquid delivery line flow path so as to cause turbulence in the flow of the respective liquids and thereby to efficiently mix the plural components into a homogeneous liquid for delivery to the applicator. Industrial plants frequently utilize reciprocable pumps which draw from the respective component containers, wherein the pumps are jointly linked and driven by a single reciprocable motor so as to withdraw the liquid components from the respective containers in a uniform ratio. The proper ratio may be selected by appropriately selecting the delivery capacity of the pumps, by controlling the respective reciprocation strokes of the pumps, or by other liquid metering devices The liquid components are subsequently conveyed along a single supply line to an applicator, although one or more mixing devices are typically inserted into the delivery line to ensure proper mixing of the proportioned liquids.

The present invention does not relate to the aforementioned mixing devices, including static mixing manifolds and other similar devices, which are primarily used to cause turbulence in the liquid flow path so as to insure thorough mixing of liquid components. Mixers of this general type will homogeneously mix liquid components, but have no capability for redistributing liquid components which may flow through the delivery lines in improper mix ratios; i.e., a static mixer will cause turbulence to thereby mix a liquid composite at a point in space along the delivery line, in whatever mix ratio the liquid composite is formed of at that mixing point.

A particular problem arises from the use of pumps, particularly reciprocable stroke pumps, which problems are evidenced during transitions from starting, stopping and stroke reversal. The volume of liquid delivered by a pump upon initial startup, or upon shutdown, can vary the optimal mix ratio of the plural components being delivered. Similarly, when a reciprocable pump changes its stroke direction, it typically causes a sudden pressure drop and pressure surge which results in a transient liquid delivery condition. These liquid transients cause the delivery system to vary from its uniform volume delivery characteristics, and when two or more reciprocable pumps are interconnected in a plural component delivery system, the respective liquid transients may occur at different instants in time. This results in liquid volumes having component ratios which are uniformly consistent in the liquid delivery lines, but interspersed by liquid volumes which may be improperly ratioed, resulting from the transient delivery conditions described above. When visualized in a liquid delivery line such activity results in a uniform flow of mixed liquid components which are properly ratioed, interspersed by intermittent "slugs" of improperly ratioed mixed components. The use of static mixers in a liquid delivery line will thoroughly mix the components moving through the lines, but will not correct component ratios which are outside of desired parameters. By and large, the plural component liquids tend to move through the delivery lines in uniformly mixed volumes, but without correcting for volume segments which may be improperly ratioed. Ratioing problems require a different form of blending of liquid volumes as the liquid passes through the delivery lines.

SUMMARY OF THE INVENTION

The present invention homogeneously distributes liquids longitudinally along the path of travel through a liquid delivery line, so as to blend the liquids more thoroughly along the longitudinal path of travel. Therefore, if a particular volume concentration of liquid is improperly ratioed the apparatus will spread the ratio errors longitudinally through the liquid delivery lines to blend together with a larger volume of liquid. The device comprises a section of delivery line which is formed into a helical path of predetermined cross section, where the inner and outer radii of the helix present a significantly greater dimension than the cross-sectional width of the path. The cross-sectional area of the helical flow path defines a "hydraulic radius" which may be calculated, and which in the preferred embodiment is less than 0.04. This causes the liquid traveling along the outside of the path to travel a much farther distance through the device as compared with the liquid traveling along the inside of the path, thereby longitudinally extending the effect of the liquid ratio passing through the device. The velocity of the liquid traveling through the device is kept substantially constant, which has the effect of integrating the liquid ratio over a greater volume of liquid flowing through the device.

It is a principal object of the present invention to provide a device for integrating the ratios of plural component liquids over an increased flow volume of liquid.

It is another object of the present invention to blend volume flow rates of liquid so as to reduce disparities in liquid ratios while the ratioed liquid is passing through a liquid delivery line.

It is another object of the invention to provide a homogeneous and uniformly-ratioed mixture of plural component liquids for delivery to a common destination.

The foregoing and other objects and advantages of the invention will become apparent from the following specification and claims, and with reference to the appended drawings.

DESCRIPTION OF THE PREFERRED EMBODIMENT

Figure 1:
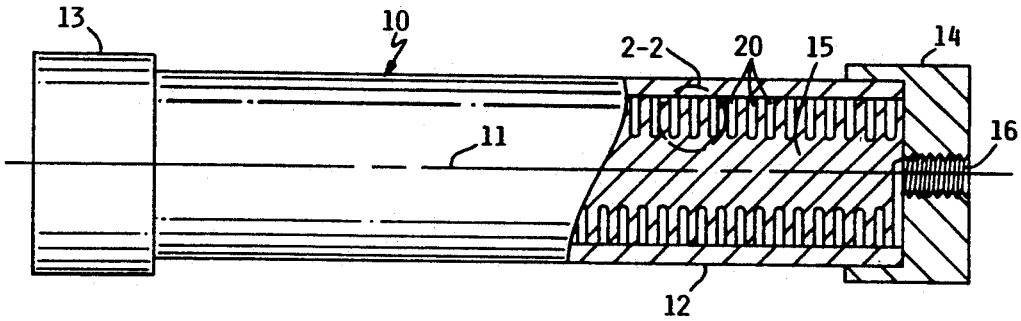
FIG. 1 shows the invention in side view and in partial breakaway cross section.
Figure 1A:
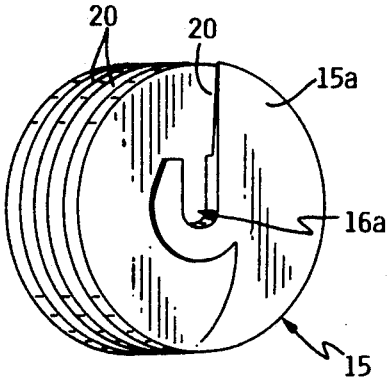
FIG. 1A shows a partial isometric end view of a portion of the invention.

Referring first to FIG. 1, the liquid integrator 10 is shown in side view and in partial cross section. The integrator 10 has an outer tubular housing 12 with a cylindrical rod 15 snugly nested therein. Rod 15 has a continuous helical groove 20 which extends across the entire transverse length of rod 15 the respective ends of integrator 10 have couplings 13, 14 adapted for threadable attachment to a liquid delivery line. Coupling 14 is shown in cross section, illustrating the central opening 16 therethrough; coupling 13 has a similar central opening therethrough, in each case the central opening is aligned in liquid flow contact with a respective end of the helical groove 20. FIG. 1A shows an isometric end view of rod 15, illustrating an opening 16*a* which is aligned in liquid flow contact with central opening 16. The end surface 15*a* of rod 15 is a flat surface for contacting against the interior surface of coupling 14. Liquid flowing into central opening 16 is guided into helical groove 20 via central opening 16*a*.

Helical groove 20 is cut about the axis 11 of rod 15, having an outer radius ($R_{OD}$) and an inner radius ($R_{ID}$), each of which are measured from axis 11. The helical groove 20 has a cross-sectional width (W) which is preferably of uniform dimension throughout the groove, or slightly outwardly tapered in certain embodiments. The outward taper should preferably be no more than about 2°-3°.

Figure 2:
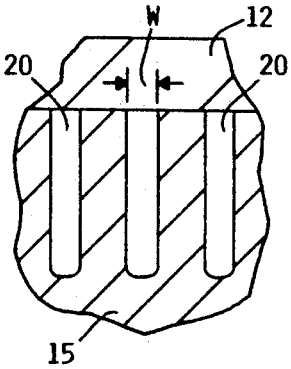
FIG. 2 shows an enlarged view of a portion of the flow path of the invention.
Figure 3A:
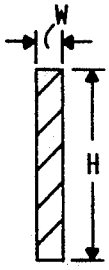
FIG. 3A shows a simplified cross-section view of the flow path.
Figure 3B:
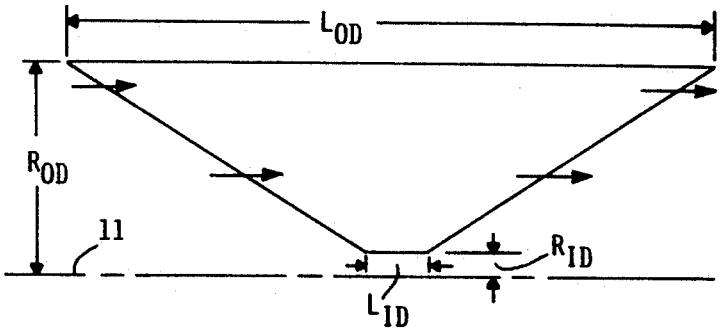
FIG. 3B shows a simplified representation of the flow path about a single revolution of the helix.

FIG. 2 shows an enlarged section 2—2, taken from FIG. 1. FIG. 3A shows a simplified diagram of the cross-sectional area of a groove 20; FIG. 3B shows a simplified view of a groove 20 which has been "unrolled" for one turn of helical revolution and shown in the form of a flat plane. The arrows in FIG. 3B indicate the liquid flow through the groove 20. Referring to FIGS. 3A and 3B, the cross-sectional area $A_1$ of the helical path through liquid integrator 10 is determined by the equation $$A_1 = WH$$

where W equals the width of the helical groove 20 and H equals the height of the helical groove 20. However, H is determined by the equation $$H = R_{OD} - R_{ID}$$

Therefore, the cross-sectional area of the groove 20 is determined by the equation $$A_1 = W(R_{OD} - R_{ID})$$

The volume of liquid which occupies one turn of revolution of the helical groove 20 is determined by multiplying the area shown in FIG. 3B by the width W of groove 20; the area shown in FIG. 3B is determined by the equation $$A_2 = \pi(R_{OD}^2 - R_{ID}^2)$$

The volume of liquid occupying one helical turn of groove 20 can then be determined by the equation $$V_1 = W.A_2$$

$$V_1 = W\pi(R_{OD}^2 - R_{ID}^2)$$

The of liquid in liquid integrator 10 is determined by multiplying the volume in one turn of helical groove 20 by the number of turns N, or $$V_{TOT} = N.V_1$$

Since it is an important function of liquid integrator 10 to blend liquid volumes flowing through a delivery line together, and to particularly blend a "slug" of liquid volume which may have become improperly ratioed as a result of the transient conditions recited hereinbefore, it is important that the total volume capacity of liquid integrator 10 be greater than the total volume delivered by the pumping system during one of the transient sequences Preferably, the total volume of integrator 10 is selected to be at least twice the volume delivered by the pumping system during a pump changeover interval.

If a constant flow velocity flows through liquid integrator 10, it is apparent that the path of liquid travel adjacent the outer diameter of the helical groove greatly exceeds the length of the path adjacent the inner diameter of the helical groove. Therefore, assuming constant flow velocity, the liquid flowing through integrator 10 proximate the outer diameter will lag the liquid flowing through the liquid integrator proximate the inner diameter, such that any incremental liquid volume which enters the liquid integrator simultaneously will leave liquid integrator 10 separated in both time and space. In effect, the liquid traveling along the outer diameter will become blended with later-arriving liquid along the inner diameter, whereas the liquid entering along the inner diameter will become blended with earlier-arriving liquid along the outer diameter, all of which serves to longitudinally blend the liquid volume passing through the delivery line. Therefore, a variation in the ratio of any incremental volume of liquid will become blended or spread longitudinally along the delivery line, thereby to integrate the ratio variation over a considerable volume of liquid. The larger the difference between the outer diameter versus the inner diameter of groove 20, the greater the lag time and therefore the greater the blending capability; likewise, the greater number of turns in helical groove 20, the greater the lag time.

The foregoing analysis assumes a constant flow velocity of the liquid through liquid integrator 10, and it is therefore important that the design parameters for constructing liquid integrator 10 be controlled so as to achieve constant flow velocity, either precisely or to a close approximation. It is also important that the width of the grooves 20 be kept as narrow as practical to prevent fluid from "channeling" through the middle section of the groove only. On the other hand, the width of the groove 20, should be large enough to permit a reasonable liquid flow rate without excessive overall pressure drops.

The work of Osborne Reynolds has shown that the determination of whether liquid flow through a pipe is either laminar or turbulent depends upon the pipe diameter, the density and viscosity of the flowing fluid, and the velocity of flow. The numerical value of a dimensionless combination of these four variables is known as the "Reynolds number," which is the ratio of the dynamic forces of mass flow to the shear stress due to viscosity. Reynolds number calculations are useful for determining flow characteristics through channels having a circular cross section. In calculations dealing with non-circular cross-section flow channels, a term referred to as the "hydraulic radius" has been invented; hydraulic radius ($R_H$) is defined as:

$$R_H = \frac{\text{Cross-sectional flow area}}{\text{Wetted Perimeter}}$$

In calculating Reynolds numbers for non-circular cross-section channels, the equivalent diameter is substituted for the circular diameter, and the equivalent diameter is defined as four times the hydraulic radius $R_H$. This equivalent diameter does not apply to flow channels where the width of the flow channel is very small relative to its length, but the hydraulic radius ($R_H$) has been found to be a useful parameter in connection with the present invention. This is believed to be true because the hydraulic radius is an index of the extent of the boundary surface of the channel in contact with the flowing fluid through the channel. In the present invention it is important that the width of the flow channel be kept as narrow as possible in order to avoid channeling through the middle section of the groove, but the groove should be sufficiently wide so as to minimize the overall pressure drop.

In order to evaluate the effectiveness of the invention in longitudinally blending different liquid components, three experiments were constructed wherein two color components were injected into the flow channel in each case. The channel width and the channel depth was varied in each case, and the hydraulic radius was calculated for each case, and the longitudinal flow blending was empirically evaluated.

Experiment No. 1

Channel Width = W = 0.06
Channel Height = H = 0.5
Channel Area = $A_1$ = 0.03
Hydraulic Radius = $R_H$ = 0.027

Experiment No. 2

W = 0.09
H = 0.7
$A_1$ = 0.063
$R_H$ = 0.040

Experiment No. 3

W = 0.125
H = 0.5
$A_1$ = 0.062
$R_H$ = 0.05

In the case of Experiment No. 1 the device provided good longitudinal liquid flow blending, but at an elevated pressure drop through the overall flow channel. In Experiment 2 the longitudinal flow blending was excellent, and the overall pressure drop was not deemed excessive. In Experiment 3 the longitudinal flow blending was relatively poor, although the pressure drop was minimal. From the foregoing, it has been determined that the invention performed satisfactorily when the hydraulic radius is less than or equal to 0.04, and hydraulic radius values greater than 0.04 provide unsatisfactory longitudinal flow blending.

As a further test the flow channel of Experiment 2 was constructed into a complete integrator, producing the following example results:

EXAMPLE

A typical integrator was designed to be utilized in a liquid delivery system for spraying paint having a viscosity of about 50 centipoise (cps); the paint is of slightly thixotropic nature, and has a flow range of 0.1 to 0.5 gallons per minute (gpm). A liquid integrator was designed having the following physical parameters:

$R_{OD}$ = 1.00
$R_{ID}$ = 0.30
W = 0.09
N = 10

The volume capacity of the foregoing integrator is 42.2 cubic centimeters (1.43 fluid ounces). This design produces a lag time coefficient of 3.33; i.e., the liquid flowing along the outer diameter will take 3.33 times as long to reach the outlet as the liquid flowing along the inner diameter. Therefore, the integrator built according to this design will adequately handle a volume flow transit of 20 cubic centimeters (cc) (0.7 fluid ounces). The foregoing calculations presume a uniform width W of groove 20; in practical applications groove 20 is made slightly larger at its outer radius than at its inner radius, to accommodate the non-newtonian fluid flow characteristics.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A liquid integrator for blending together leading and lagging liquid flow volumes in a liquid delivery line, comprising a housing having an axial opening therethrough; means proximate respective ends of said axial opening for sealably connecting said housing into said liquid delivery line; an insertion member substantially filling said axial opening; said insertion member having a helical groove extending about an outer surface, with respective ends of said helical groove in liquid flow contact with respective ends of said axial opening; said helical groove having a cross-sectional width dimension about one-eighth the cross-sectional height dimension of said groove.

2. The apparatus of claim 1, wherein said helical groove is substantially rectangular in cross section.

3. The apparatus of claim 2, wherein said helical groove has a hydraulic radius value less than 0.04.

4. The apparatus of claim 3, wherein the length of said groove is sufficient to permit storage of at least 1–5 fluid ounces of liquid in said groove.

5. A liquid integrator for blending together leading and lagging liquid flow volumes in a liquid delivery line, comprising an enclosed helical path having a rectangular cross-sectional area; means for coupling respective ends of said helical flow path into said liquid delivery line in serial liquid flow arrangement; the width dimension of said cross-sectional area being sufficiently small so as to create a substantially uniform liquid pressure drop across said width dimension in liquid flowing through said helical path, the width dimension being about one-eighth the height dimension of said cross-sectional area.

6. The apparatus of claim 5, wherein said helical path has a hydraulic radius of less than 0.04.

7. The apparatus of claim 6, wherein said helical path has a height dimension sufficiently large so as to create a substantially constant liquid flow velocity in liquid flowing through said helical path.

* * * * *